United States Patent [19]

Krekler

[11] 4,015,312

[45] Apr. 5, 1977

[54] TAB PULLER AND SLIDE FASTENER PROTECTOR

[76] Inventor: Marion M. Krekler, 13824 Jersey, Norwalk, Calif. 90650

[22] Filed: Aug. 23, 1976

[21] Appl. No.: 716,978

[52] U.S. Cl. ..... 24/205.15 H
[51] Int. Cl.[2] ..... A44B 19/26
[58] Field of Search ..... 24/205.15 A; 294/1 A

[56] References Cited

UNITED STATES PATENTS

| | | | |
|---|---|---|---|
| 2,983,977 | 5/1961 | Guerin | 24/205.15 H |
| 3,059,301 | 10/1962 | Dierks | 24/205.15 A |

*Primary Examiner*—Bernard A. Gelak
*Attorney, Agent, or Firm*—William R. Piper

[57] ABSTRACT

A tab puller and slide fastener protector which has two arms pivotally connected together at their ends in spaced relation and adapted to be swung with respect to each other in substantial parallel planes. The upper arm is provided with a housing designed to receive the tab of the slide fastener when the lower arm is swung away from the upper one. The lower arm, when swung back into juxtaposition with respect to the upper arm, cooperates therewith to form a receiving area for the slide fastener. The lower arm performs the additional function of preventing the slide fastener from becoming entangled with any undergarment of the wearer. The slide fastener tab, when received within the housing, prevents the accidental freeing of the slide fastener from the pulling device. The pivotal connection between the two arms has an opening therein for receiving a pull cord by means of which the slide fastener is moved. The generic term, slide fastener, is used for what is frequently called by the trademark, zipper. The lower arm is also used for unzipping the slide fastener.

7 Claims, 6 Drawing Figures

TAB PULLER AND SLIDE FASTENER PROTECTOR

SUMMARY OF THE INVENTION

My invention is to provide a tab puller for a slide fastener to be used in moving the slide fastener into closed or open position where the slide fastener is applied to the back of a garment such as a woman's dress. It is quite common for a woman who wants to wear such a garment to ask someone else to move the slide fastener into closed position because of the inaccessibility of the pulling tab to the wearer. Also it is difficult to move the slide fastener if a fluffy undergarment is worn because the slide fastener is likely to become entangled with the undergarment.

An object of my invention is to provide a device which may be readily connected to the tab of a slide fastener which is located in a part of the garment that is difficult for the wearer to reach when the garment is worn. The connection of the tab of the slide fastener is made before the garment is put on and a pull cord, connected to my device can be pulled for moving the slide fastener into closed position by the person wearing the garment.

A further object of my invention is to provide a device of the type described in which the lower arm cooperates with the upper arm for receiving the slide fastener and for preventing it from becoming entangled with an undergarment during the movement of the slide fastener into closed position. The lower arm also can be connected to the tab of the slide fastener when it is desired to unzip the slide fastener.

BRIEF DESCRIPTION OF THE DRAWING

FIG. 4 is taken along the line 4—4 of FIG. 2.

FIG. 5 is shown in order to illustrate by dot-dash lines a slide fastener tab that is flat rather than substantially overshaped in cross section.

DESCRIPTION OF THE PREFERRED EMBODIMENT

Figure 1:
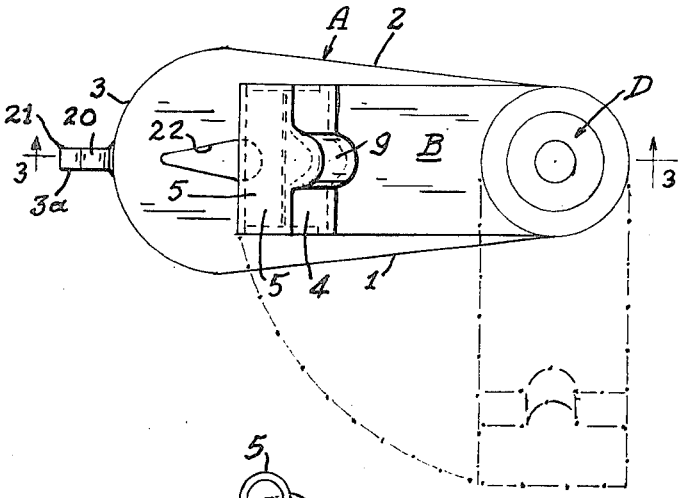
FIG. 1 is a top plan view of the device and illustrates by dot-dash lines the lower arm swung into open position.
Figure 2:
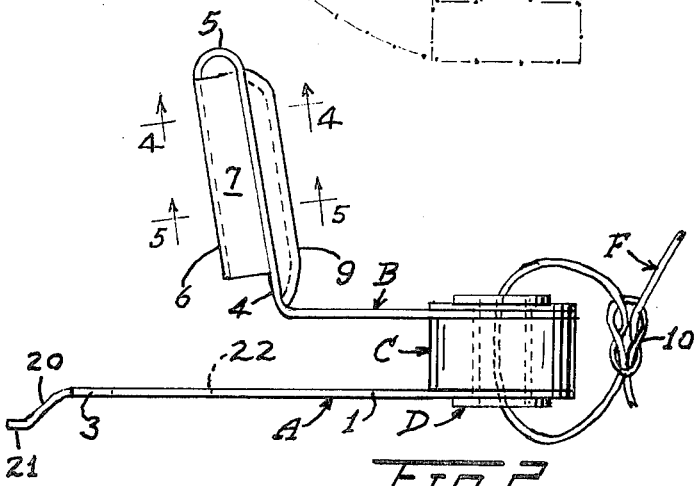
FIG. 2 is a side elevation of FIG. 1 and shows the pull cord being connected to the device.
Figure 3:
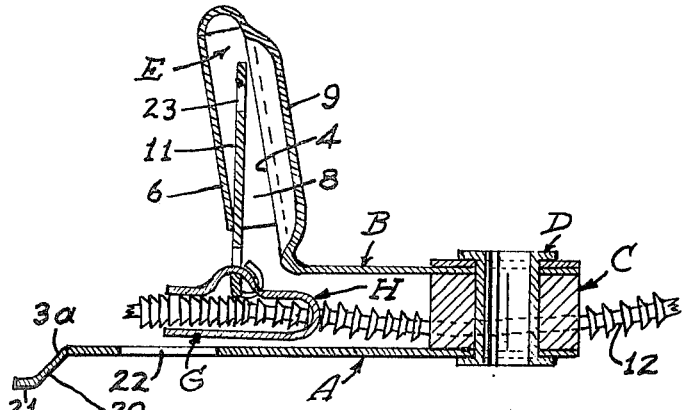
FIG. 3 is a longitudinal section taken along the line 3—3 of FIG. 1 and illustrates the slide fastener in section and with its tab being received in the housing formed in the underside of the upper arm.

In carrying out my invention I provide a lower arm indicated generally at A, and an upper arm B, see FIG. 2. Both arms are preferably made from flat material such as sheet metal or a plastic. Each arm has an appreciable flexibility in its structure. A sleeve C, is placed between both arms A and B, at one of their ends and a hollow rivet D pivotally connects the two arms together. The lower arm A, is shown in plan view in FIG. 1, and it has outwardly flared side edges 1 and 2 and a semi-circular rounded end 3 with a tongue 3*a*. The lower arm is flat for the greater part of its length and is designed to slide under the slide fastener as shown in FIG. 3 in order to prevent the slide fastener teeth from becoming ensnared with an undergarment being worn by the person using the device. This will be explained more in detail later on in this description.

Figure 4:
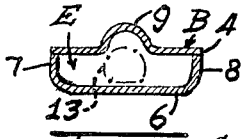
FIG. 4 is a transverse section through the housing portion of the upper arm and illustrates by dot-dash line a slide fastener tab being received within the housing, the tab being substantially oval in cross section.
Figure 5:
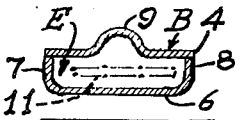
FIG. 5 is a transverse sectional view similar to FIG. 4 and is taken along the line 5—5 of FIG. 2.

The upper arm B has a portion 4 upwardly inclined at an angle of about 80° with respect to the plane of the lower arm A, see FIGS. 2 and 3. Also, the portion 4 has its outer end folded back upon itself through an arc of 180° at 5, and the bent back portion 6 parallels the upwardly inclined portion 4 and is spaced therefrom. Both FIGS. 4 and 5 are transverse sections taken along the lines 4—4 and 5—5 of FIG. 2, and show that the bent back portion 6 of the upper arm B, is provided with upwardly extending side flanges 7 and 8 whose outer edges contact the undersurface of the adjacent portions of the upwardly inclined part 4 and may be welded thereto to form a housing E. The upwardly inclined part 4 of the upper arm B, has an outwardly and longitudinally extending convex portion 9 therein forming a cavity on its under surface, see especially FIGS. 3, 4 and 5.

A pull cord F for the device, is being shown as having one end passed through the interior of the hollow rivet D, and being tied at 10 to connect the pull cord to the device, see FIG. 2.

OPERATION

From the foregoing description of the various parts of the device, the operation thereof may be readily understood. The slide fastener is indicated generally at G, in FIG. 3. In order for the slide fastener to be connected to the device, the lower arm A is swung into the dot-dash line position with respect to the upper arm B, as clearly shown in FIG. 1. This will permit the tab 11 of the slidable connector and disconnector H for the teeth 12 in the slide fastener G to be placed in the housing E. The tab 11 may be flat as shown in FIGS. 3 and 5 or it may be substantially oval-shaped in cross section as indicated by the dot-dash lines 13 in FIG. 4. The cavity on the underside of the elongated buldge 9 is formed to receive the tab 13.

It should be noted from FIG. 3, that when the tab 11 or the tab 13 is received in the housing E, the slidable connector H will be held in place because the lower arm A underlies the slide fastener G. There is sufficient space between the two arms A and B to receive the slidable connector G when the operator swings the lower arm from the open dot-dash line position shown in FIG. 1, back into closed position to underlie the slidable connector H, as shown in FIG. 3. In this way the slidable connector is secured in proper position in the device and it can not become accidentally disconnected therefrom.

The lower arm A also provides the additional novel function of sliding along on the underside of the slide fastener teeth 12 as the slidable connector is moved by pulling on the cord F. The lower arm A prevents any undergarment from becoming entangled with the teeth 12 of the slide fastener during the fastening process of the two adjacent rows of teeth 12 in the slide fastener. The person who is to wear the garment where the slide fastener G is in almost an inaccessible place when the garment is worn, such as at the back of the garment, secures the slide connector H to the device in the manner above described before the garment is put on. The cord F is then placed over the shoulder of the wearer and is pulled for moving the slidable connector H into closed position. When this is accomplished, the upper arm B, is swung away from its superimposed position over the lower arm A so that the slidable connector H can be freed and its tab 11 or 13 removed from the housing E. The lower arm can now be removed from its position underlying the slide fastener G.

I have thus far set forth the operation of the device when zipping the slide fastener into closed position by a person wearing the garment. Now, I will describe how the lower arm A, is fashioned so as to be connectible to the slide fastener tab for unzipping the slide fastener. Reference to FIG. 1, shows the rounded edge 3 terminating in the tongue 3*a* while FIGS. 2 and 3 illustrate the tongue as being bent at 20 to form an offset portion at 21. The lower arm A has an opening 22 therein with edges inclined with respect to each other so that the opening is wider at one end that at the other.

Figure 6:
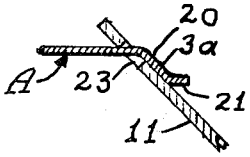
FIG. 6 is a side elevation of the end portion of the lower plate and is shown inserted in a slot in the tab of the slide fastener. In this manner the lower arm is coupled to the slide fastener tab which is illustrated in longitudinal section. Such a coupling is resorted to when the device is used for unzipping the slide fastener.

In FIG. 6, I show the slide fastener tab 11 with its slot 23. The tongue 3*a* of the lower arm A is inserted in the slot 23 in the manner shown so that when the pull cord F moves the device, it will pull the tab 11 to move the device for unzipping the slide fastener. Should the tab 13 be of a substantial oval-shape in cross section then such a tab would be inserted into the wedge-shaped opening 22 in the lower arm A and would become wedged between the inclined side edges of this opening. In this manner the tab 13 would be connected to the device and a movement of the device would move the tab 13 of the slide fastener to unzip it.

I claim:

1. A device of the type described comprising:

a. a lower arm;

b. an upper arm;

c. means for pivotally interconnecting the ends of the two arms together and for spacing them apart so that the lower arm can be swung from a closed position where the lower arm underlies the upper arm, into an open position where the lower arm is swung away from the upper arm but still lies in a plane substantially parallel to the plane in which the upper arm swings;

d. said upper arm having a housing whose entrance is adapted to receive the tab of a slide fastener, the tab being held in said housing when the lower arm is swung back into a position underlying the upper arm; and e. a cord connected to the device for pulling it along the slide fastener for interconnecting the two rows of teeth of the slide fastener.

2. The combination as set forth in claim 1: and in which a. said lower arm has a width wider than that of the slidable connector which connects the two rows of teeth to each other or disconnects them from each other;

b. the lower arm underlying the slide fastener and preventing any undergarment from becoming ensnared in the teeth of the slide fastener during the operation thereof.

3. The combination as set forth in claim 1: and in which a. said housing has a cavity in its upper wall for receiving the slide fastener tab which is substantially oval-shaped in cross section.

4. The combination as set forth in claim 1: and in which a. the upper arm has an upwardly inclined portion that has the housing on its underside for inclining the housing at the proper angle for receiving the tab of the slidable connector and holding the tab at an angle of about 80° to the plane of the lower member.

5. The combination as set forth in claim 1: and in which a. said pivotal means that interconnects the two arms and holds them in spaced relation one to the other, consists of b. a sleeve positioned between the two arms and disposed adjacent to their ends; and c. a hollow rivet extending through the sleeve and pivotally connecting the two arms to said sleeve at opposite ends thereof, said cord having one end extending through said hollow rivet.

6. The combination as set forth in claim 1: and in which a. said lower arm has a tongue at its free end provided with an offset portion, said tongue being receivable in a slot in the tab of the slide fastener for connecting the tongue to the tab;

b. whereby a movement of the device will move the tongue and tab therewith for unzipping the slide fastener.

7. The combination as set forth in claim 1: and in which a. said lower arm has a wedge-shaped opening for receiving the tab of a slide fastener, the tab becoming wedged between the inclined edges of the opening for connecting the tab to said lower arm;

b. whereby a movement of the device will move the lower arm and the tab for unzipping the slide fastener.

* * * * *